US008188965B2

(12) United States Patent
Yang

(10) Patent No.: US 8,188,965 B2
(45) Date of Patent: May 29, 2012

(54) TEMPERATURE SENSOR FOR LIQUID CRYSTAL DISPLAY DEVICE

(75) Inventor: Hung-Ming Yang, Tainan (TW)

(73) Assignee: Himax Technologies Limited, Sinshih Township, Tainan County (TW)

( * ) Notice: Subject to any disclaimer, the term of this patent is extended or adjusted under 35 U.S.C. 154(b) by 1055 days.

(21) Appl. No.: 12/118,334

(22) Filed: May 9, 2008

(65) Prior Publication Data

US 2009/0121999 A1 May 14, 2009

Related U.S. Application Data

(62) Division of application No. 10/916,815, filed on Aug. 13, 2004, now Pat. No. 7,492,344.

(51) Int. Cl.
*G09G 3/36* (2006.01)

(52) U.S. Cl. ..... 345/101; 345/106; 349/161

(58) Field of Classification Search ..... 345/101, 345/106; 349/161
See application file for complete search history.

(56) References Cited

U.S. PATENT DOCUMENTS 3,812,717 A 5/1974 Miller et al.
5,386,543 A 1/1995 Bird
6,019,508 A 2/2000 Lien
6,414,740 B1 7/2002 Hosoyamada
6,552,708 B1 4/2003 Wang et al.
6,674,185 B2 1/2004 Mizuta
6,758,224 B2 7/2004 Nogami
6,831,626 B2 12/2004 Nakamura et al.

OTHER PUBLICATIONS http://en.wikipedia.org/wiki/Langmuir_probe, pp. 1-3.*

* cited by examiner

*Primary Examiner* — Kevin M Nguyen
(74) *Attorney, Agent, or Firm* — Baker & McKenzie LLP

(57) ABSTRACT

A temperature sensing apparatus for a liquid crystal display device is disclosed. The apparatus can measure the device temperature without the existence of a conventional PN junction. The temperature sensing apparatus comprises at least one thin-film transistor (TFT) cell, a variable current source, a buffer and a sensing circuit. Each TFT cell has its respective drain and gate coupled together and a source coupled to a ground The variable current source is coupled to the drain of the TFT cell. The buffer has an input coupled to the drain of the TFT cell. The sensing circuit has an input coupled to an output of the buffer and an output to produce a voltage output signal. The temperature of the TFT cell is determined by inputting two currents at a sub-saturation region of the TFT cell and measuring voltage output signal difference.

6 Claims, 3 Drawing Sheets

TEMPERATURE SENSOR FOR LIQUID CRYSTAL DISPLAY DEVICE

RELATED APPLICATIONS INFORMATION

This application claims priority as a Divisional application U.S. patent application Ser. No. 10/916,815, entitled "TEMPERATURE SENSOR FOR LIQUID CRYSTAL DISPLAY DEVICE", filed Aug. 13, 2004, incorporated herein in its entirety as if set forth in full,

BACKGROUND OF THE INVENTION

1. Field of the Invention

This invention relates to a temperature sensing circuit, and more particularly to a temperature sensing circuit fabricated on a thin-film transistor substrate.

2. Description of the Related Art

In modern days, video display devices play an important role in our daily life. Information and communication massages are transmitted and then displayed in those devices. Generally, display devices are classified into luminous types and non-luminous types. Luminous type display devices are cathode ray tube (CRT) and light emitting diode (LED), while non-luminous type displays include liquid crystal display (LCD) and the likes.

The LCD displays offer the advantages of compact volume and power saving compared with the conventional CRT displays. A liquid crystal display device capable of performing the color display by making use of a display element such as liquid crystal, and combining the light source and a color filter has been known. For example, U.S. Pat. No. 6,513,236 by Tsukamoto disclosed such a LCD package structure (the entire disclosure of which is herein incorporated by reference). A thin film transistor controls the liquid crystal display device in which a picture element to perform one color display is constituted by combining three primary colors of red (R), green (G) and blue (B). A large number of the picture elements is arranged in the display region: the signal line and the scanning line are arranged in the matrix to drive the liquid crystal; the pixel electrode is arranged in the region demarcated by the signal line and the scanning line; switching to the pixel electrodes is performed by the thin film transistor; the electrical field is applied to the liquid crystal corresponding to each pixel; and the transmittance ratio of the liquid crystal is changed to switch the display/non-display.

The active matrix LCD (AMLCD) uses a thin-film transistor (TFT) substrate to form image pixels and to provide driving current. Therefore, it fulfills the requirements of being lightweight/thin/small in volume and reducing the production cost. Referring now to FIG. 1, it shows a schematic diagram of a conventional AMLCD pixel cell structure.

The TFT cell includes a transistor 102 to drive an LCD device 106. The transistor 102 has a gate connected to a scan line, a source connected to a data line, and a drain connected to the anode of the LCD device 106, which has a cathode further connected to the ground. When the scan line goes high, the transistor 102 turns on; thereby the data line voltage VDATA is input into the LCD device 106 to turn on the pixel.

The characteristics of a TFT LCD, such as response time and contrast, are easily affected by temperature variation. A temperature sensing and control circuit is usually incorporated on the TFT LCD display panel to compensate this effect. Conventionally, the temperature sensing circuit is made of a series of PN junctions, such as that disclosed in U.S. Pat. No. 5,366,943 by Kelly et al. (the entire disclosure of which is herein incorporated by reference). However, in the materials currently employed for TFT substrate such as amorphous silicon (α-Si) or polysilicon, no PN junction exists in the TFT substrate. Therefore, there is a need for temperature sensing circuit on the TFT substrate. There is also a need for a new temperature sensing circuit which can be fabricated without the PN junction. Further, there is a need to effectively control the temperature of the TFT substrate.

SUMMARY OF THE INVENTION

The present invention is directed to solving these and other disadvantages of the prior art. The present invention provides a temperature sensing circuit which is fabricated on a thin-film transistor substrate and can easily detect current temperature on the substrate. The present invention also provides a temperature control circuit which is fabricated on the thin-film-transistor substrate to control the temperature on the substrate. The LCD brightness and response time can be improved by precisely controlling the temperature of the TFT cell.

One aspect of the present invention contemplates a temperature sensing apparatus for a liquid crystal display device. The temperature sensing apparatus comprises at least one thin-film transistor (TFT) cell, and a temperature sensing element can directly sense the temperature of the TFT cell. The temperature is determined by inputting two currents at a sub-saturation region of the TFT cell and measuring voltage output signal difference.

Another aspect the present invention provides a temperature sensing apparatus for a liquid crystal display device. The temperature sensing apparatus comprises at least one thin-film transistor (TFT) cell, a variable current source, a buffer and a sensing circuit. Each TFT cell has its respective drain and gate coupled together and a source coupled to a ground. The variable current source is coupled to the drain of the TFT cell. The buffer has an input coupled to the drain of the TFT cell. The sensing circuit has an input coupled to an output of the buffer and an output to produce a voltage output signal. The temperature of the TFT cell is determined by inputting two currents at a sub-saturation region of the TFT cell and measuring voltage output signal difference.

Yet another aspect the present invention provides a method of sensing temperature for a TFT cell of a liquid crystal display device that is comprising the steps of providing a first current in a sub-saturation region of the TFT cell into a drain of the TFT cell, measuring a first voltage output, providing a second current in a sub-saturation region of the TFT cell into the drain of the TFT cell, measuring a second voltage output, and determining the temperature of the liquid crystal display device.

BRIEF DESCRIPTION OF THE DRAWINGS

The accompanying drawings are included to provide a further understanding of the present invention, and are incorporated in and constitute a part of this description. The drawings illustrate embodiments of the present invention, and together with the description, serve to explain the principles of the present invention. There is shown.

DESCRIPTION OF THE PREFERRED EMBODIMENTS

The invention disclosed herein is directed to a temperature sensing circuit which is fabricated on a thin-film transistor substrate and can easily detect current temperature on the substrate. The temperature of the thin-film transistor substrate can be controlled and adjusted with a temperature controlling circuit designed according to the present invention. In the following description, numerous details are set forth in order to provide a thorough understanding of the present invention. It will be appreciated by one skilled in the art that variations of these specific details are possible while still achieving the results of the present invention. In other instances, well-known backgrounds are not described in detail in order not to unnecessarily obscure the present invention.

Figure 1:
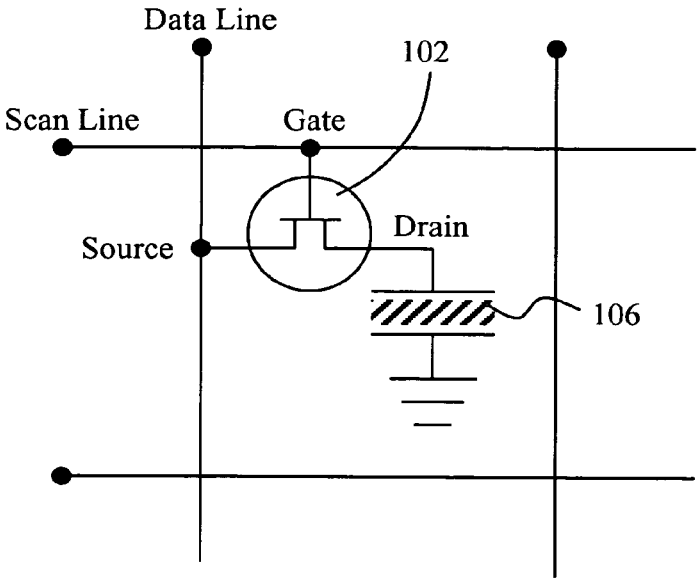
Fig. 1 (Prior Art)
FIG. 1 illustrates a schematic diagram of a conventional AMLCD pixel cell structure.
Figure 2:
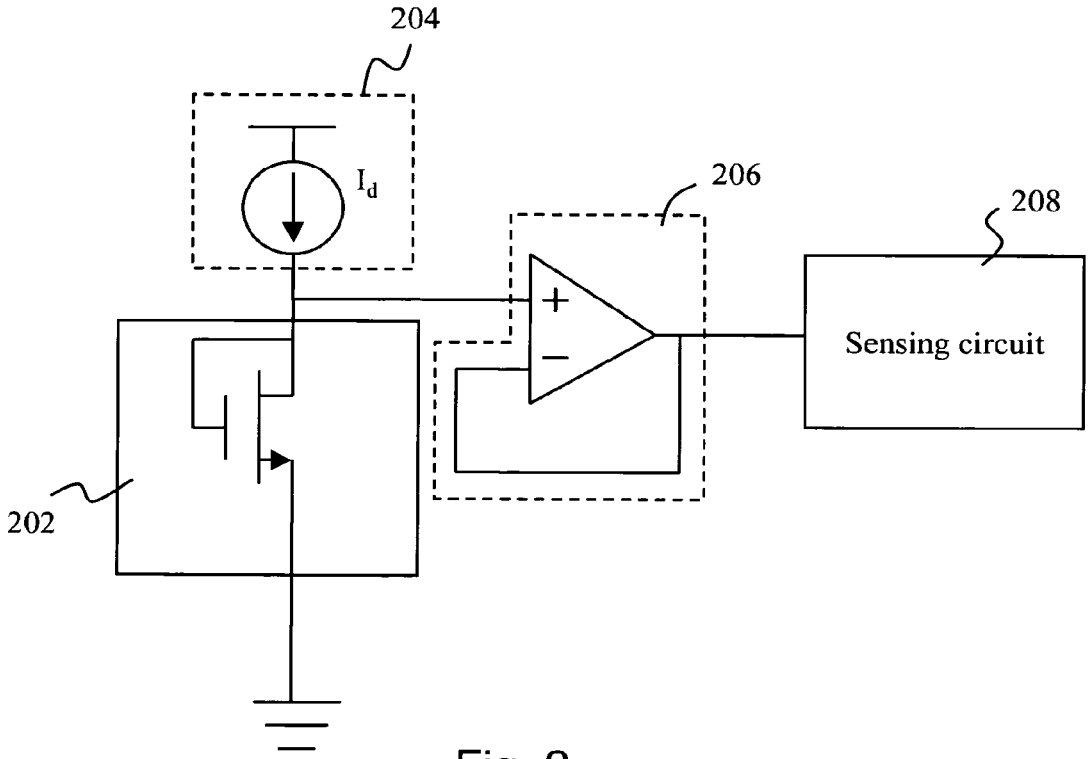
FIG. 2 illustrates a schematic diagram representation of a temperature sensing system according to a preferred embodiment of the present invention.

Referring now to FIG. 2, there is shown a schematic diagram of a temperature sensing circuit according to a preferred embodiment of the present invention. The temperature sensing circuit comprises a TFT cell 202, a variable current source 204, a buffer 206 and a sensing circuit 208. The drain of the TFT cell 202 is connected to the variable current source 204 and the input of the output buffer 206, while the output of the buffer 206 is coupled to the sensing circuit 208 for obtaining the temperature of the TFT cell. The gate and drain of the TFT cell 202 are connected together, and the source connects to the ground as shown in the Figure.

Figure 3:
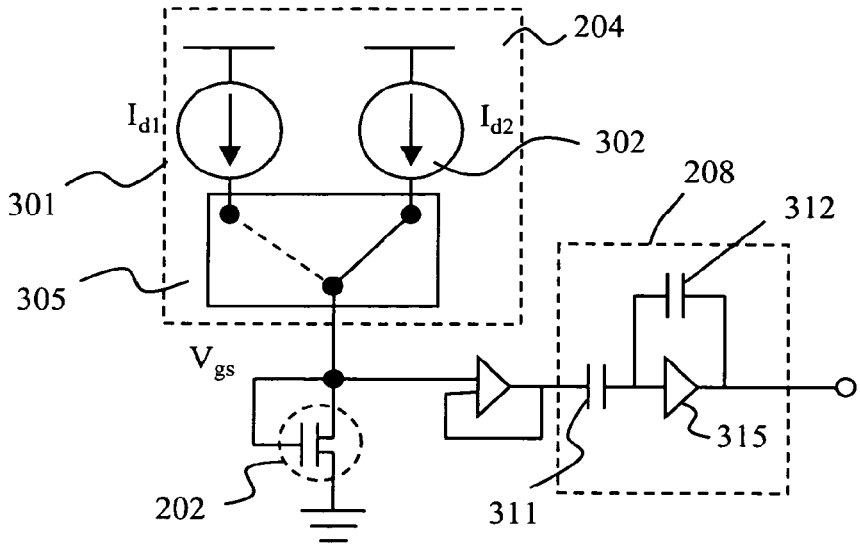
FIG. 3 illustrates a detailed circuit representation of a preferred temperature sensing system according to the present invention.

Referring now to FIG. 3, there is shown a detailed circuit representation of the preferred temperature sensing system according to the present invention. In one embodiment, the variable current source 204 comprises two current sources 301, 302 and a switch 305 to select the output current level. The sensing circuit 208 simply comprises a pair of capacitors 311, 312 and an operational amplifier 315. Other sensing circuits can also be used and adapted in accordance with the present invention, for example, U.S. Pat. No. 4,448,549 by Hashimoto et al. discloses a different temperature sensing circuit structure (the entire disclosure of which is herein incorporated by reference).

Figure 4:
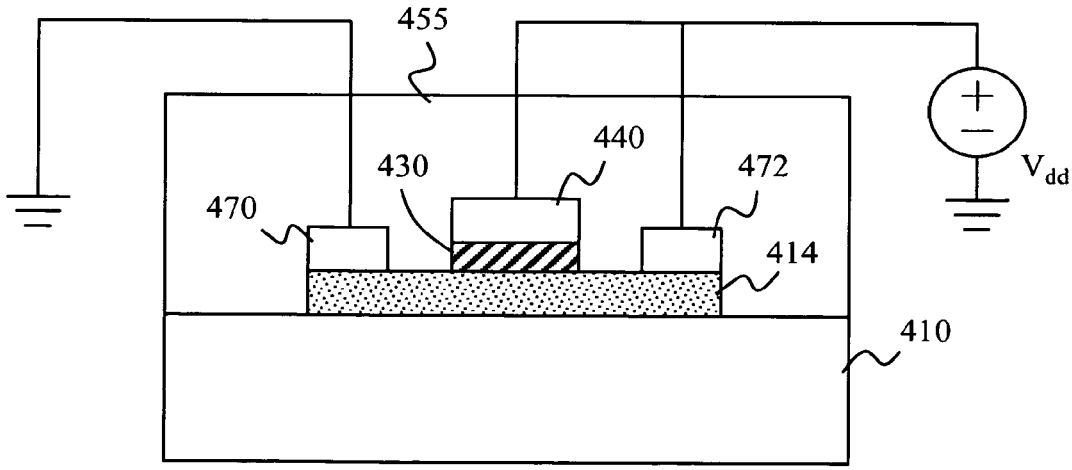
FIG. 4 illustrates a cross-sectional view of a TFT cell corresponding to FIG. 2.

Referring now to FIG. 4, there is shown a cross-sectional view of the TFT cell corresponding to FIG. 2. The AMLCD device is configured to form the TFTs on a glass substrate 410. In one embodiment, it is shown with a top gate TFT structure. Other types of TFT structure such as bottom gate can be used as well. As well known in the art, a semiconductor channel layer 414, a gate dielectric layer 430 and a gate electrode 440 are formed over the glass substrate 410 to start the formation of the TFT cell. The semiconductor channel layer preferably is amorphous silicon (α-Si) with a thickness of about 100 nm to 1000 nm. Other types of silicon materials such as polysilicon or low temperature polysilicon (LTPS) can be used as well. The gate dielectric layer 430 is preferably chemical vapor deposited silicon oxide. Other suitable gate dielectric materials such as silicon nitride and techniques can also be used. The gate electrode 440 can be formed of a conductive metal, and preferably is aluminum. Other types of refractory metals such as Cr, Ta or Ti can also be used.

Thereafter, source and drain regions 470, 472 are formed over the channel region 414 and a passivation layer 455 is formed to cover the above structure. In one embodiment, the source and drain are formed with N+ doped amorphous silicon. Alternatively, P+ doped amorphous silicon or other doped polysilicon can also be used. As described before, the source 470 connects to the ground, the gate 440 and drain 472 of the TFT cell 202 which are connected to a drain bias voltage Vdd together as shown in the Figure.

Figure 5:
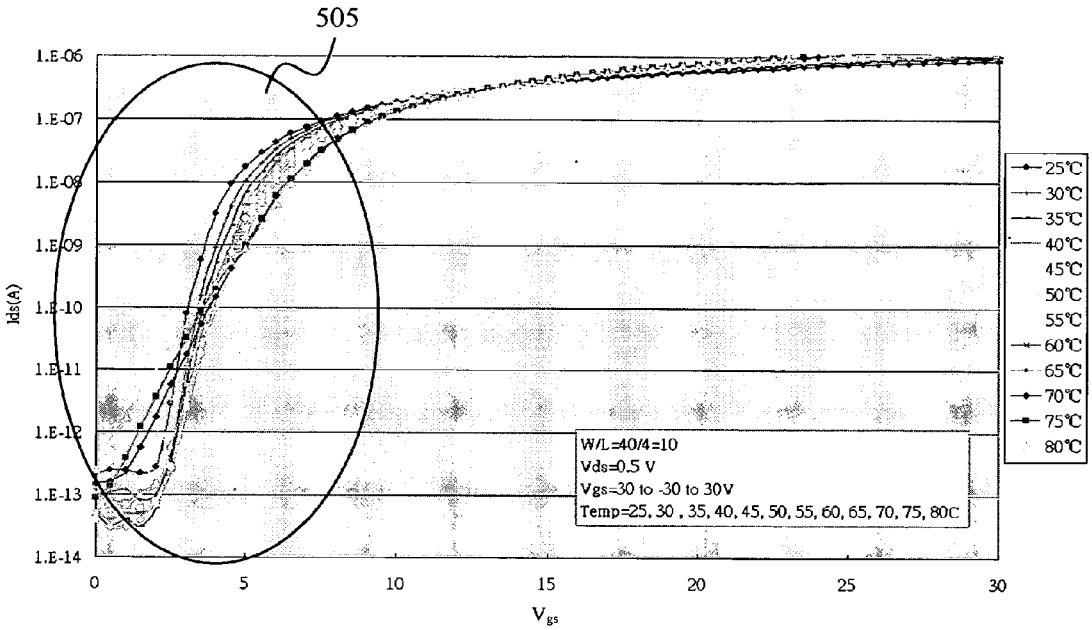
FIG. 5 illustrates a current-voltage characteristics of a TFT cell according to a preferred embodiment of the present invention.

Referring now to FIG. 5, it shows the current-voltage characteristics, which vary with respect to temperature sensed on a TFT cell, designed in accordance with the present invention. When the TFT cell is operated in the sub-threshold (or so-called linear) region 505, the drain current Ids can be represented in such an equation:

$$Ids=Id0\exp(qVgs/nkT) \quad (1)$$

where Id0 is a constant, q is the unit electronic charge (in coulomb), Vgs is the voltage difference between gate and source, n is the carrier concentration in the drain, k is Boltzmann's constant and T is the absolute temperature (in Kelvin) of the transistor.

The voltage difference Vgs between two input Ids values in the sub-threshold (or so-called linear) region can be measured in such an equation:

$$Vgs=nkT/q*\mathrm{Ln}(Ids1/Ids2) \quad (2)$$

In operation, a first current Ids1 is inputted into the sub-saturation region of the TFT cell, and the sensing circuit can therefore obtain a first voltage Vgs1. Then, the current source is switched to provide a second current Ids2 still in the sub-saturation region into the TFT cell to allow the sensing circuit to obtain a second voltage Vgs2. Thereafter, the voltage difference Vgs, the actual temperature can be determined, i.e. based on the equation 2. In the preferred embodiment, the current source Ids1 is 1.0E-8 Amperes and the current source Ids2 is 1.0E-9 Amperes. We can easily determine the temperature based on Equation 2. By knowing current temperature of the TFT cell, additional control circuit can be incorporated on the TFT cell to compensate the temperature variation effect. Therefore, the temperature of the LCD device can be precisely controlled, a better performance can be achieved.

Figure 6:
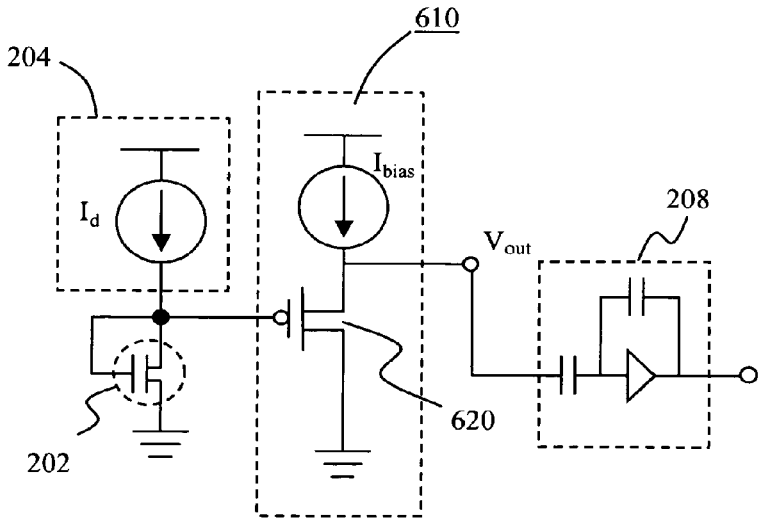
FIG. 6 illustrates a detailed circuit representation of a temperature sensing system according to an alternative embodiment of the present invention.

Referring now to FIG. 6, there is shown a detailed circuit representation of the temperature sensing system according to an alternative embodiment of the present invention. In this alternative embodiment, the buffer can be replaced by other types of high impedance circuit such as source follower 610 to read out the voltage signal. The source follower 610 comprises a current source Ibias and a PMOS 620 which has a gate connected to the drain of the TFT cell, a source connected to the ground and a drain to read out the voltage signal Vout as described before.

One of the main purposes of the present invention is to provide an improved structure of a thin-film transistor substrate for active matrix liquid crystal display applications that can easily detect current temperature on the substrate. Another main object of the present invention is to provide an improved structure of a thin-film-transistor substrate for active matrix liquid crystal display applications by controlling the temperature of the thin-film-transistor substrate. These and other objects of the present invention can be achieved by providing novel temperature sensing circuit which can convert the output voltage into the real temperature. Thus, the LCD brightness and response time can be improved thereof by controlling the precise temperature of the TFT cell.

Although the present invention has been described in considerable detail with references to certain preferred versions thereof, other versions and variations are possible and contemplated. For example, the buffer can be other type of high impendence circuits other than the exemplary embodiment. More over, although the present disclosure contemplates one implementation forming the amorphous silicon semiconductor channels directly over the TFT substrate, it may also be applied in a similar manner to reverse the whole TFT structure up side down, such as forming the gate electrodes directly over the TFT substrate or the like.

Finally, those skilled in the art should appreciate that they can readily use the disclosed conception and specific embodiments as a basis for designing or modifying other structures for carrying out the same purpose of the present invention without departing from the spirit and scope of the present invention as defined by the appended claims.

What is claimed is:

1. A method of sensing a temperature of a TFT (thin film transistor) cell in a liquid crystal display device, comprising:

applying a first current in a sub-saturation region of a TFT cell at a drain of the TFT cell;

while the first current is applied on the drain of the TFT cell, measuring a first voltage value between a gate and a source of the TFT cell;

applying a second current in the sub-saturation region of the TFT cell at the drain of the TFT cell;

while the second current is applied on the drain of the TFT cell, measuring a second voltage value between the gate and the source of the TFT cell; and determining a temperature of the TFT cell by applying a computation on the first and second voltage values.

2. The method of sensing a temperature of a TFT cell in a liquid crystal display device according to claim 1, wherein the temperature of the TFT cell is determined based on a relationship between the first current, the second current, the first voltage value and the second voltage value.

3. The method of sensing a temperature of a TFT cell in a liquid crystal display device according to claim 2, wherein the temperature of the TFT cell is computed based on a formula $\Delta V - nkT/q*Ln(I_{ds1}/I_{ds2})$, $\Delta V$ is the voltage difference between the first voltage value and the second voltage value, $I_{ds1}$ is the first current, $I_{ds2}$ is the second current, q is the unit electronic charge, n is a carrier concentration, k is Boltzmann's constant and T is an absolute temperature.

4. The method of sensing a temperature of a TFT cell in a liquid crystal display device according to claim 1, wherein the TFT cell is formed from amorphous silicon.

5. The method of sensing a temperature of a TFT cell in a liquid crystal display device according to claim 1, wherein the TFT cell is formed from polysilicon.

6. The method of sensing a temperature of a TFT cell in a liquid crystal display device according to claim 1, wherein the TFT cell is formed from low temperature polysilicon (LTPS).

* * * * *